US006230457B1

(12) United States Patent
Brautigam

(10) Patent No.: US 6,230,457 B1
(45) Date of Patent: May 15, 2001

(54) SAG PREVENTION OF WINDOWS

(76) Inventor: Richard H. Brautigam, 10 Georgian Cir., Newark, DE (US) 19711-2551

( * ) Notice: Subject to any disclaimer, the term of this patent is extended or adjusted under 35 U.S.C. 154(b) by 0 days.

(21) Appl. No.: 09/193,754

(22) Filed: Nov. 17, 1998

Related U.S. Application Data

(60) Provisional application No. 60/065,617, filed on Nov. 18, 1997.

(51) Int. Cl.[7] ..... E04B 3/964

(52) U.S. Cl. ..... 52/204.69; 52/204.5; 292/158; 292/139; 292/336.3; 403/348; 403/353; 49/252

(58) Field of Search ..... 52/204.5, 204.62, 52/204.69; 49/252, 396, 417, 434, 450, 454; 292/23, 158, 336.3, 139; 403/348, 353; 16/235, 239

(56) References Cited

U.S. PATENT DOCUMENTS 4,991,886 * 2/1991 Nolte ..... 292/161
5,074,075 * 12/1991 See ..... 49/252
5,118,145 * 6/1992 Tucker ..... 292/158
5,448,857 * 9/1995 Stormo ..... 49/417
5,791,700 * 8/1998 Biron ..... 292/7
5,829,802 * 11/1998 Anderson ..... 292/336.3
5,927,768 * 7/1999 Dallmann ..... 292/158

OTHER PUBLICATIONS

Multi–Point Locking System brochure, 1992.
Multi–Point Locking System brochure, 1993.

* cited by examiner

*Primary Examiner*—Beth A. Stephan
(74) *Attorney, Agent, or Firm*—Connolly Bove Lodge & Hutz

(57) ABSTRACT

A casement window utilizes a multi-locking system having a pair of spaced keepers and a tie bar with a corresponding pair of rollers. In the locking action the rollers ride against the inclined and straight vertical surfaces of the keepers. A lifting block is located immediately above the lower roller when the locking system is in its locked condition. The lifting block prevents sagging and supports the sash in the locked condition. The provision of a lifting block in combination with the known multi-point locking system takes advantage of the locking system components to prevent sagging.

22 Claims, 6 Drawing Sheets

SAG PREVENTION OF WINDOWS

CROSS REFERENCE TO RELATED APPLICATION

This application is based upon provisional application Serial No. 60/065,617, filed Nov. 18, 1997.

BACKGROUND OF THE INVENTION

Casement windows include a sash hinged to a frame or jamb so that by rotation of the handle the window could be moved to an open position or a closed position. Various structures have been suggested to attempt to provide a firm locking of the sash to the frame. Problems exist, however, regarding the window sagging while in the locked as well as the open condition.

SUMMARY OF THE INVENTION

An object of this invention is to provide a sag prevention and correcting system for windows, particularly casement windows.

A further object of this invention is to provide such a sag prevention system which operates in connection with the locking arrangement.

In accordance with this invention the sag prevention system is used with a locking arrangement wherein the sash includes at least one and preferably a pair of spaced keepers of a multi-point locking system. The frame has a tie bar arrangement with a roller for each keeper. When the window is rotated to its closed condition the handle for the tie bar arrangement is moved to slide the rollers upwardly for engagement with the keepers. In accordance with the invention a lifting block is located adjacent one of the keepers to be disposed directly above its roller when the window is in the locked condition. The lifting block may be integral with the keeper or may be a separate member. Any sagging is prevented by the lifting block contacting the roller.

THE DRAWINGS

DETAILED DESCRIPTION

Figure 1:
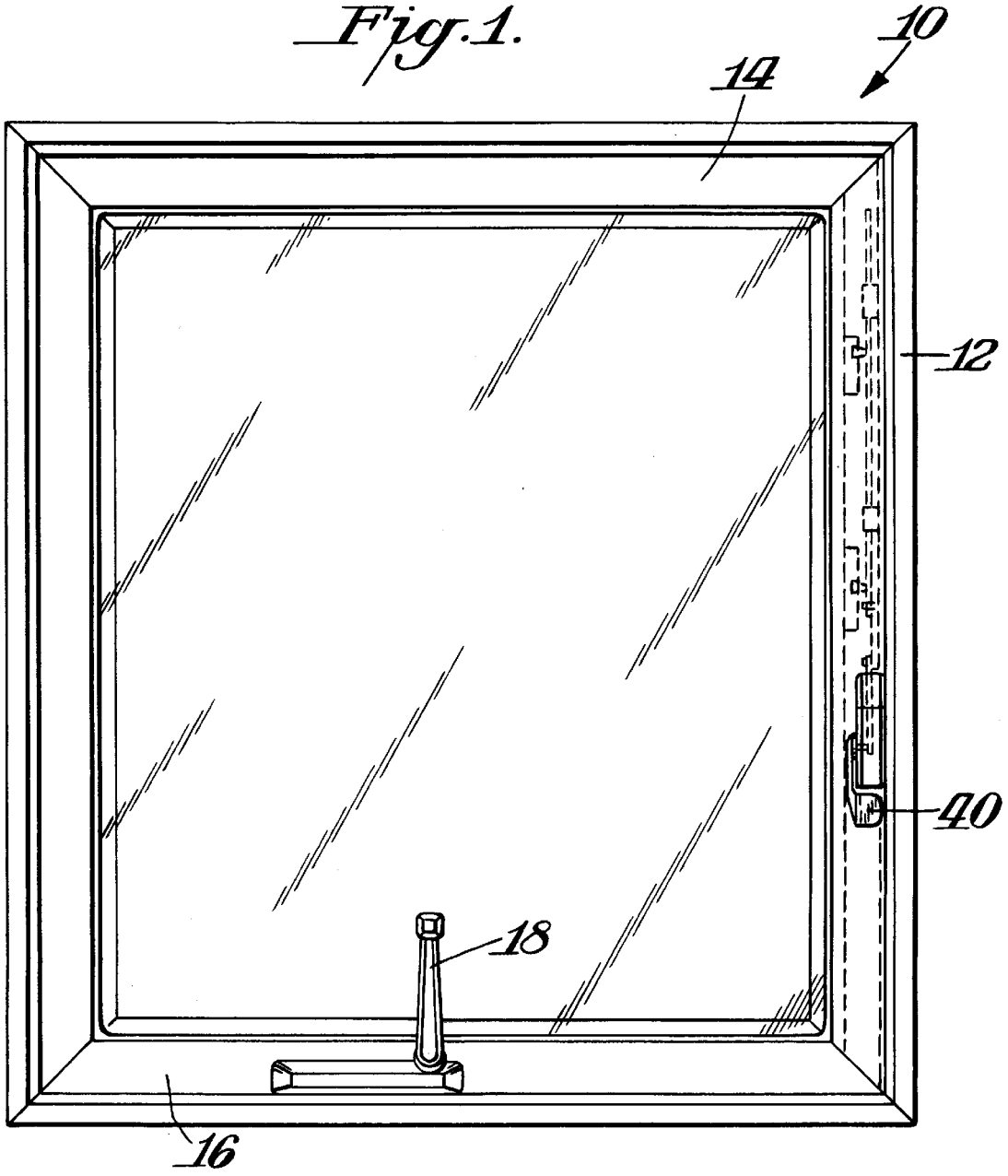
FIG. 1 is a front elevational view of a casement window in the locked condition in accordance with this invention.

FIG. 1 illustrates a casement window 10 which includes a frame or jamb 12 and a sash 14 which extends around the window pane itself. Sash 14 is hinged to frame 12 by hinge arms at the bottom area 16 of the window assembly so that the window can be moved to an open position or a closed position. The rotation is controlled by handle 18 in a known manner and its details are not critical to an understanding of this invention.

FIGS. 2–5 illustrate the details of the invention wherein a sag prevention system is incorporated with locking members of a known multi-point locking system on the sash and frame. Reference is made to U.S. Pat. Nos. 5,074,075, 5,118,145 and 5,448,857, the details of which are incorporated herein by reference thereto with regard to the known multi-point locking system with which the invention may be adapted. The invention thus has the advantage of requiring only minor structural additions to the known locking system.

Figure 2:
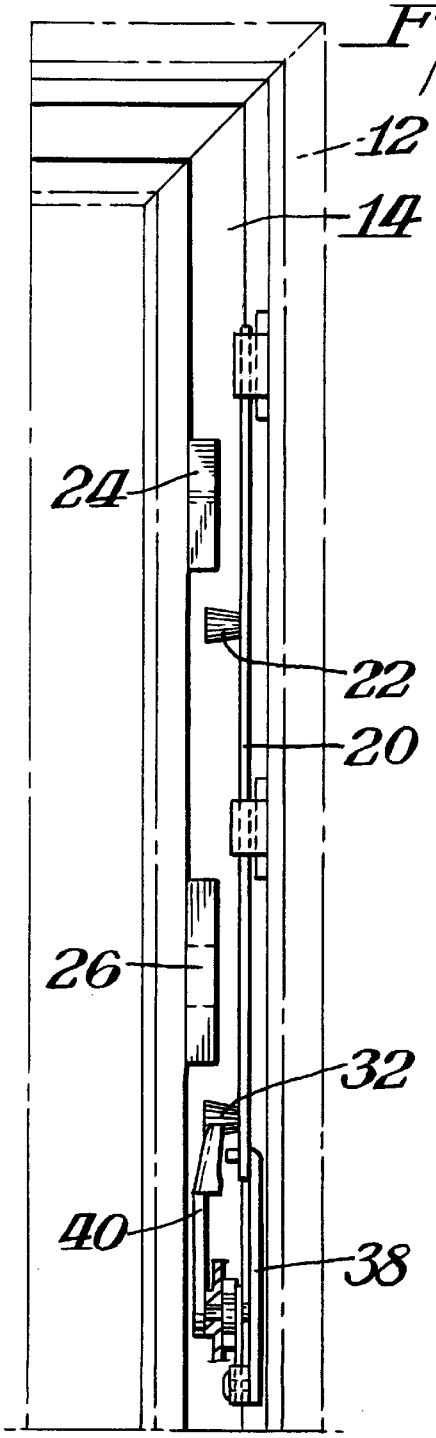
FIG. 2 is a fragmental front elevational view of the casement window in the unlocked condition.
Figure 3:
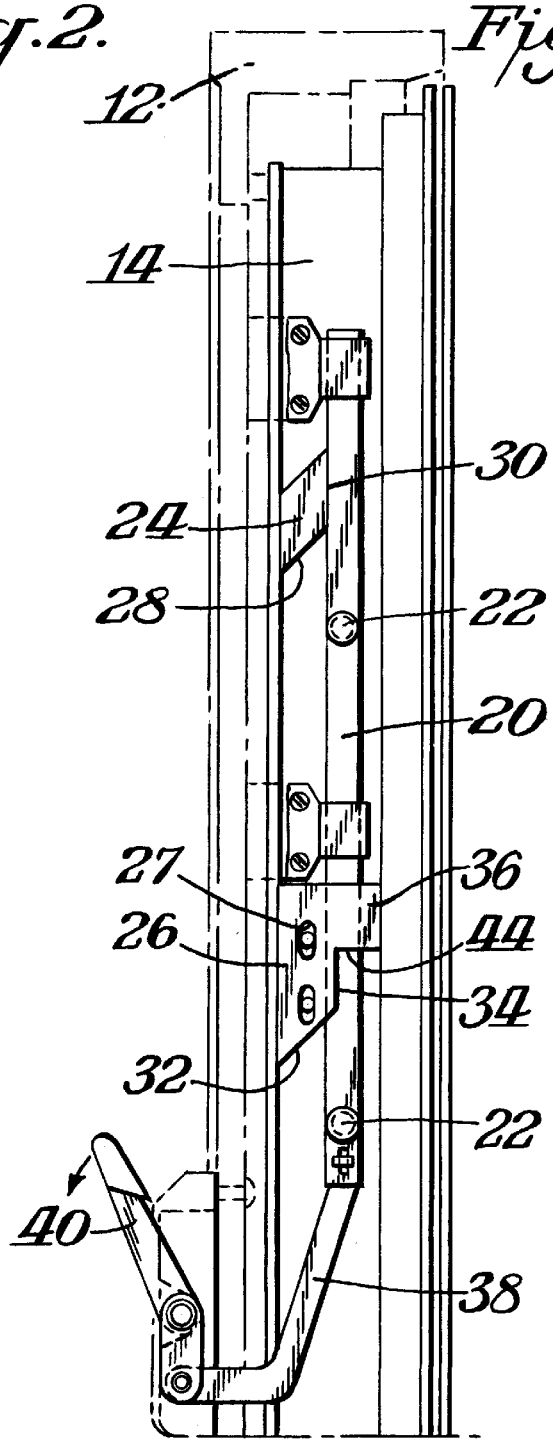
FIG. 3 is a fragmental side elevational view of the window shown in FIG. 2.
Figure 7:
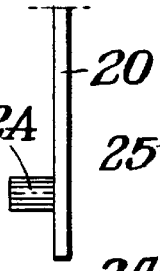
FIG. 7 is a fragmental end elevational view of a tie bar having a cylindrical roller.
Figure 8:
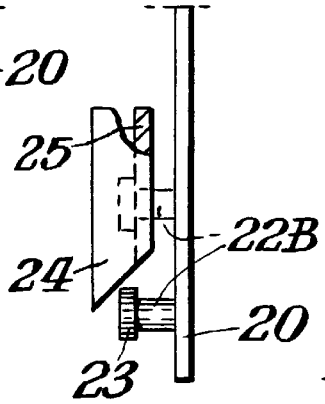
FIG. 8 is a fragmental and elevational view of a tie bar having a shouldered roller and a keeper with a flange.

As shown in FIGS. 2–3 the various components are in their unlocked condition. FIG. 2 illustrates a tie bar 20 having a pair of spaced rollers or abutment members 22 which may be frusto-conically shaped, as shown in FIG. 2 or may have other types of shapes such as shown in FIGS. 7 and 8. It is to be understood that while the members 22 are referred to as rollers, it is not necessary in the broad practice of the invention that the members 22 actually rotate. What is important is that the members 22 present an abutment surface as later described. Members 22 may be considered first abutment members. The tie bar 20 is mounted to the frame 12. A pair of second abutment members keepers 24,26 is mounted to the sash, as shown in FIG. 3. Keeper 24 has an inclined cam edge 28 and a vertical guide surface or straight guide edge 30. Keeper 26 has an inclined cam edge 32 and a straight guide edge 34. In accordance with this invention a lifting block 36 is disposed outwardly from the upper end of straight edge 34. Although only one lifting block 36 is illustrated in FIG. 3, it is to be understood that the invention may be practiced with a lifting block for each roller as illustrated in phantom in FIG. 5 by the reference numeral 36A. Similarly, while a pair of rollers and keepers are illustrated, the invention may be broadly practiced with only a single roller and keeper.

Figure 4:
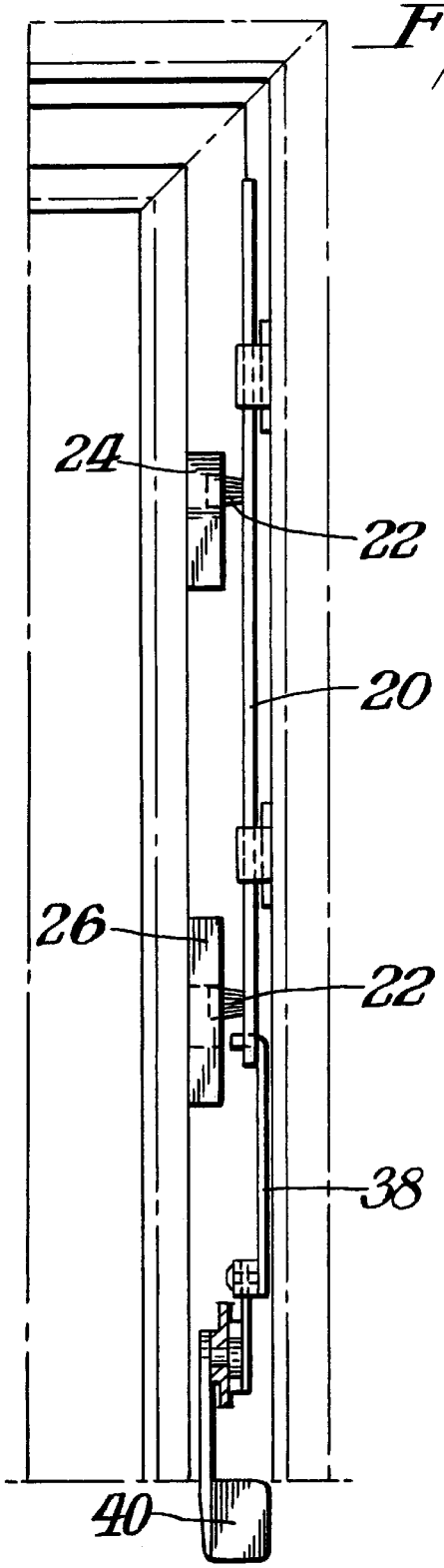
FIG. 4 is a fragmental front elevational view of a casement window in the locked condition.
Figure 5:
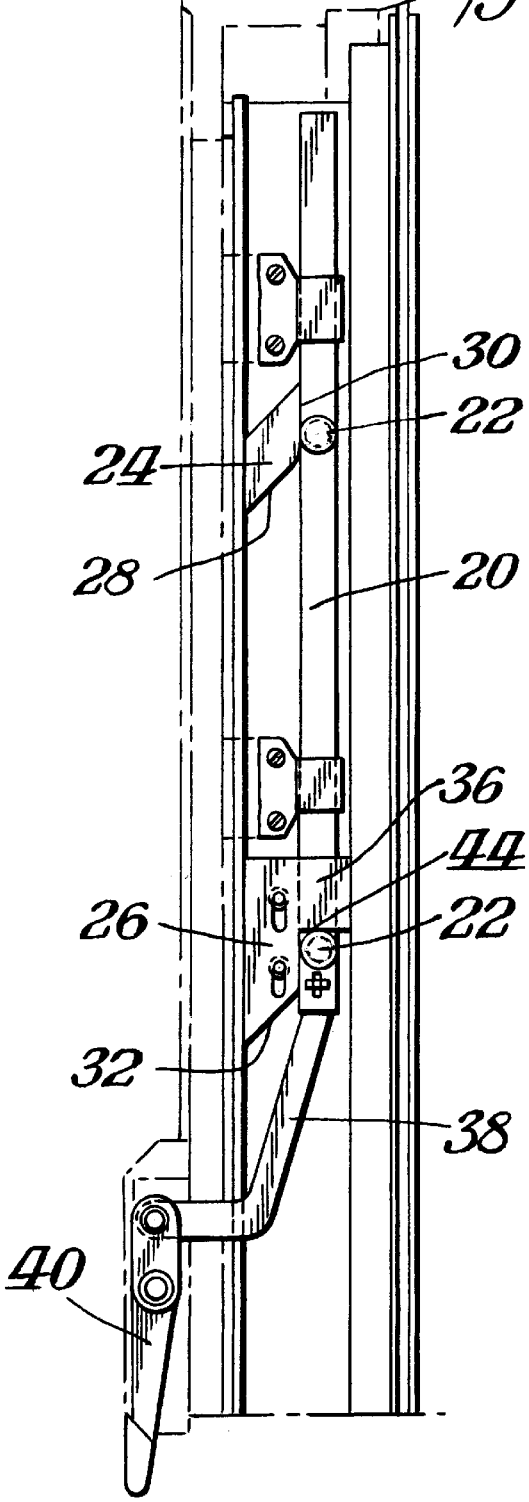
FIG. 5 is a fragmental side elevational view of the window shown in FIG. 4.

Tie bar 20 is mounted to a link 38 which in turn is mounted to a pivotable handle 40. When handle 40 is in the up position the tie bar is in its unlocked condition where the rollers 22 are spaced from the keepers 24,26. When handle 40 is rotated downwardly the tie bar is shifted upwardly and the rollers contact the keepers, as shown in FIGS. 4–5.

The sequential contacting of the keepers takes place by the lower roller 22 first contacting and rolling against inclined cam edge 32 of lower keeper 26. When the lower roller reaches the junction with straight guide edge 34 upper roller 22 begins to contact inclined cam edge 28 of upper keeper 24. Similarly, where abutment member 22 is a roller, the roller may but need not rotate. In continued upper movement of the rollers, the lower roller 22 rides against straight guide edge 34 while upper roller 22 rides against inclined edge 28 and ultimately straight guide edge 30. When the rollers are both located at the straight edges the window sash is pulled tightly against the weather seals of the frame.

Thus, as described above, each keeper is in the path of movement of the vertically moving roller 22 so that when the rollers 22 contact the inclined and straight edges of each keeper, a locking results.

In accordance with this invention lifting block 36 is mounted outwardly of straight edge 34 generally in line with or more accurately across the path of movement of lower roller 22. Lifting block 36 is illustrated in FIGS. 3 and 5 as being integral with keeper 26 and extending outwardly from guide edge 34. It is to be understood, however, that the invention may be practiced where the lifting block is a separate element mounted adjacent to and upwardly from keeper 26.

FIGS. 4–5 show the condition of the components in the fully locked position. As shown therein, lower roller 22 is located directly below lifting block 36 when upper roller 22 is along straight guide edge 30 of upper keeper 24. In the fully locked condition roller 22 would be at the lower edge 44 of block 36. If there should be any tendency for the sash to sag, such tendency is prevented by lower roller 22 acting as an abutment against edge 44 for lifting block 36 thereby preventing downward movement or sagging of the sash, or lifting the sash if it has sagged while in the open position.

Preferably, lifting block 36 is located at lower keeper 26. The invention, however, may also be practiced by having the lifting block at the upper keeper 24 located directly above the upper roller 22 when the handle 40 is moved to its down position as shown in FIGS. 4–5. The invention may also be practiced by having a lifting block for each keeper, particularly when used with a heavy sash. The preferred practice of the invention is illustrated where there is a single lifting block located at the lower keeper 26 and where the sash is not particularly heavy.

As noted, the lifting block 36 may be integral with keeper 26 or may be a separate member located directly above the lower roller 22. Not only does lifting block 36 prevent sagging and support the sash in its locked position, but also the lifting block corrects minor sag while the sash is in its open position.

The invention may be practiced by having one or both keepers or lifting block 36 vertically adjustable in its location on sash 14. FIG. 3, for example, illustrates a pair of slots 27 to be formed in keeper 26 so that the keeper 26 could be slidably moved up or down and then locked in position by the illustrated screws or fasteners.

Figure 6:
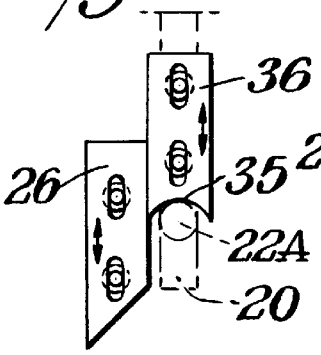
FIG. 6 is a fragmental side elevational view of a modified form of keeper/lifting block arrangement in accordance with this invention.

Any other suitable structure may be used to permit the vertical adjustability of the keepers and/or lifting block. FIG. 6, for example, illustrates the lifting block 36 to include the same type of slot/fastener arrangement so as to be independently movable with respect to keeper 26. FIG. 6, further illustrates a variation of the invention where the contact surface 35 of lifting block 36 is arcuate to receive cylindrical roller 22A. The cylindrical roller is also shown in FIG. 7.

FIG. 8 shows a variation of the invention where one of the keepers such as keeper 24 has a flange 25 for contacting roller 22B which is in the form of a cylinder having an outwardly extending shoulder 23 which rides against flange 25.

Where lifting block 36 is not integral with keeper 26 the two pieces could have mating teeth or cams engaged with each other to effect vertical movement of one piece with respect to the other. Where vertical adjusting structure is used care should be taken to take into account the weight of the window as it might affect the efficiency of performance of the vertical adjusting structure.

Figure 9:
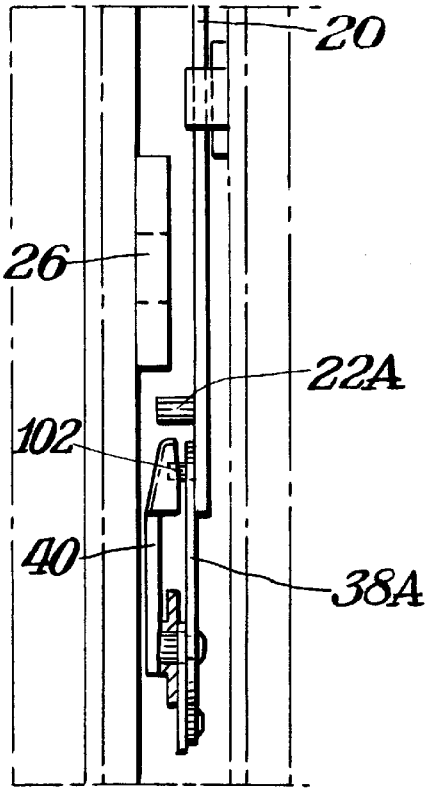
FIG. 9 is a fragmental front elevational view showing a casement window in its unlocked condition having a modified form of link structure.
Figure 10:
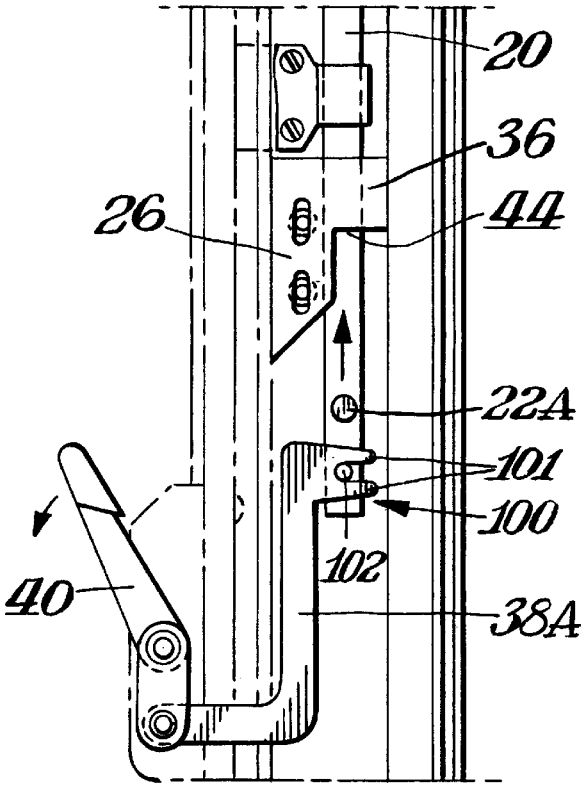
FIG. 10 is a fragmental side elevational view of the arrangement shown in FIG. 9.

FIGS. 9–10 show a variation of the invention wherein the link 38A associated with handle 40 is connected to tie bar 20 by a fork structure 100 wherein the fork arms or prongs 101 are disposed on each side of a pin 102 fixed on tie bar 20.

Figure 11:
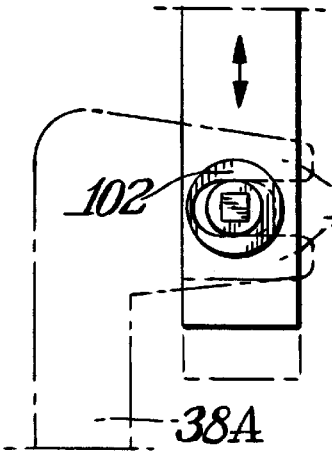
FIG. 11 is a fragmental side elevational view showing yet another form of vertical adjustment mechanism in accordance with this invention.
Figure 12:
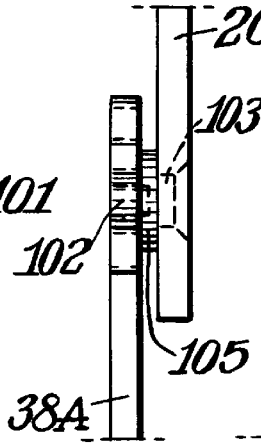
FIG. 12 is a fragmental end elevational view of the arrangement shown in FIG. 11.

FIGS. 11–12 illustrate a further vertical adjustment mechanism which may be used in accordance with this invention. As shown therein, the pin 102A is eccentrically mounted or may be of elliptical form so that upon rotation of the pin the forked end of link 38A is moved up or down. For example, as shown in FIG. 12, the eccentrically mounted pin 103 is secured to tie bar 20 with a cam disk 105 disposed between link 38A and tie bar 20. Rotation of eccentric pin 103 affects the precise location of link 38 at its area of mounting to tie bar 20. A known mechanism commonly referred to as TORX would provide this type of adjustment.

Figure 13:
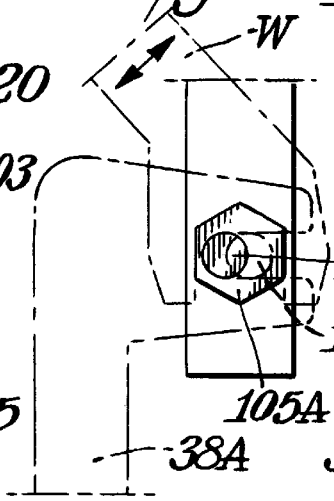
FIG. 13 is a fragmental side elevational view showing still yet another form of vertical adjustment mechanism in accordance with this invention.
Figure 14:
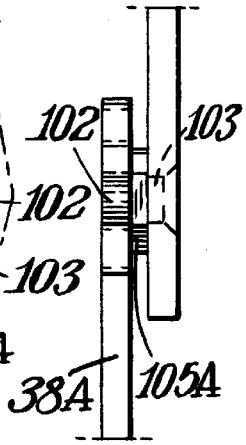
FIG. 14 is a fragmental end elevational view of the arrangement shown in FIG. 13.

FIGS. 13–14 illustrate yet another form of vertical adjustment mechanism wherein a hexagonal cam disk 105A is mounted to pin 103 so that rotation of pin 103 causes pin 102 disposed between the fork arms of link 38A to move the arms upwardly or downwardly. Such adjustment may be easily achieved by using a conventional adjustment wrench W.

Figure 15:
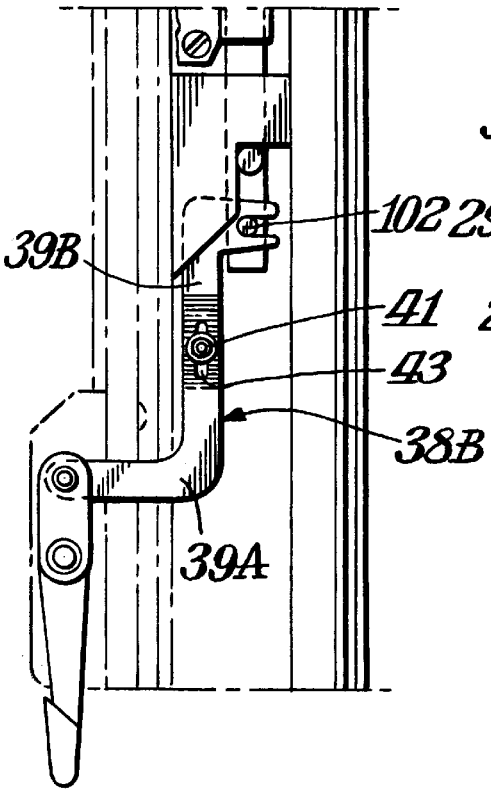
FIG. 15 is a fragmental side elevational view of yet another form of vertical adjustment mechanism in accordance with this invention.

FIG. 15 illustrates yet another manner of adjustment wherein the link 38B is made of two parts 39A and 39B which are connected together by a suitable fastener 41 extending through elongated slot 43 thereby controlling the degree of overlap of link parts 39A and 39B.

Figure 16:
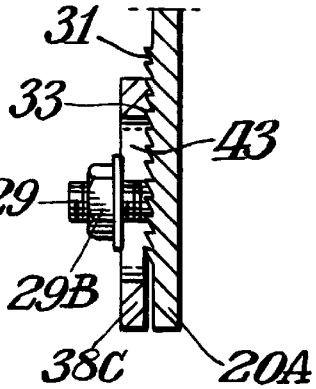
FIG. 16 is an enlarged fragmental end view showing a vertical adjustment mechanism for the link in accordance with this invention.

FIG. 16 illustrates yet another form of adjustment where link 20A is provided with teeth 31 for engagement with complementary teeth 33 on link 38C. A suitable threaded fastener 29 and nut 29B may be manipulated to move the mating teeth 31,33 into and out of engagement with each other.

Figure 17:
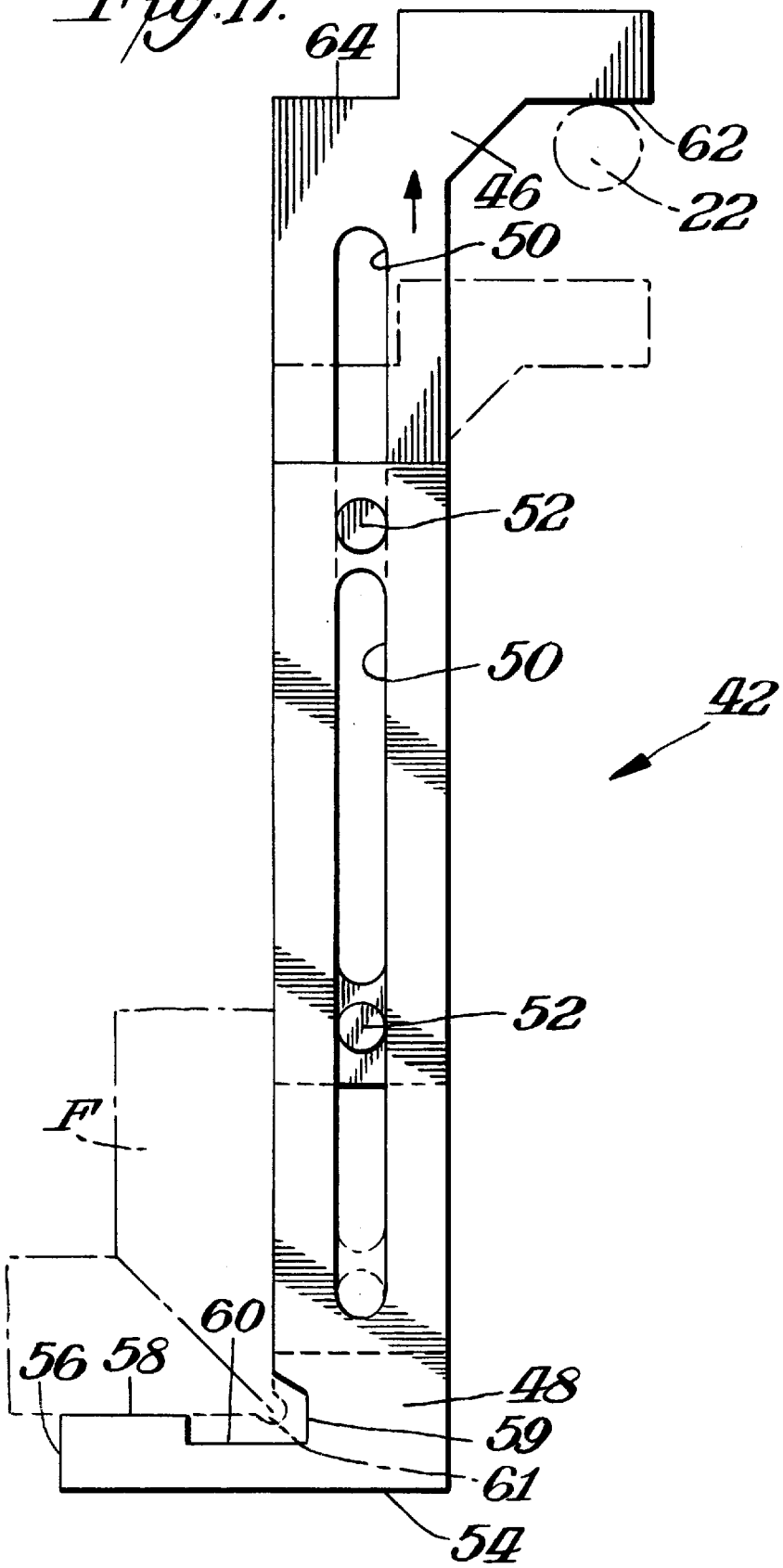
FIG. 17 is a front elevational view of a gauge used for locating the lifting block in the window of FIGS. 1–5.

FIG. 17 illustrates a gauge 42 which may be used for properly positioning the lifting block and more particularly its lower edge 44 on the sash. As shown therein gauge 42 is of two piece construction for locating the bottom keeper lifter on casement windows with multi-point locking systems. A pair of sliding members 46,48 comprise gauge 42. Each member includes a slot 50 into which pins 52,52 of the other member are slidably mounted. The members 46,48 can be locked together in any suitable manner once the proper height adjustment can be achieved.

Lower member 48 includes a lower surface 54 which would be placed on the bottom hinge track of frame 12. A side wall 56 is dimensioned to correspond to the stack height of the hinge and spacers, if used. Such height might, for example, be 7/16 inches. Surface 58 would be set in the bottom sash arm mounting surface. A cutout 60 avoids contact with weld flash. For example, the cut out 60 includes a relief notch 59 with a recess 61 to accommodate any weld flash at the corner of the window frame F, shown in phantom. Surface 62 of upper member 46 would correspond to the top tangent surface of the bottom roller in the locked position. This would also correspond to the lower edge 44 or 35 of lifting block 36. A similar surface 64 in line with surface 62 is provided also to correspond to the tangible surface of the bottom roller. Either of the surfaces 62,64 could be used for determining where the lifting block 36 should be located with regard to its lower surface.

Thus, in use the surface 54 would be placed on the bottom hinge track. Members 46,48 would be slidably adjusted so that surface 62 or 64 would be tangent to the bottom roller 22 in the locked position. Members 46,48 would then be locked to fix this distance. Surface 58 would be set in the bottom hinge sash arm mounting surfaces. By the proper placement and selection of the various surfaces in gauge 42, accurate placement of the lifting block 36 can be assured.

The above procedure allows for the proper placement and location of the lifting block 36 with respect to roller 22. If it is more desirable to adjust the location of the roller in order to obtain the proper alignment and positioning with respect to the lifting block 36 the following procedure can be used. Surface 58 of gauge 42 would be set in the bottom hinge sash arm surface. Slide members 46,48 would be selectively adjusted so that surface 62 or 64 would correspond to the location of surface 44 or 35 of lifting block 36. Members 46,48 would then be locked to fix this distance. Surface 54 would be placed on the bottom hinge track surface. Roller 22 would then be adjusted so that roller 22 would be tangent to surface 62 or 64. This adjustment of the location of roller 22 could be made by using the various techniques shown in FIGS. 11–14 and/or 17.

Gauge 42 is useful not only in retrofitting existing windows to add a separate lifting block, but could also be used in original manufactured windows to be sure of proper location of the roller and the lifting block whether the lifting block is integral with the lower keeper or is a separate member.

It is to be understood that the invention may be practiced in manners other than specifically shown and described. For example, the tie bar may be mounted to either the sash or the frame with the fixed abutment member mounted on the other of the sash or the frame. The tie bar may have the roller as its movable abutment member, as described, or the keeper may be mounted on the tie bar and be an abutment member with the roller or abutment member on the other of the sash or the frame. Where the keeper is mounted on the tie bar, the keeper may be considered as a second abutment member and the roller would be a first abutment member. In these variations the lifting block would be disposed across the path of movement of the movable or second abutment member so as to be contacted by the second abutment member when the window assembly is in its locked position to minimize sag and to correct for sag.

What is claimed is:

1. A system for minimizing sag in a window assembly comprising a sash hinged to a frame for selectively being moved to a locked position and an unlocked position, said system including a first abutment member on said sash, a tie bar on said frame, a second abutment member on said tie bar, a handle connected to said tie bar for moving said tie bar and said second abutment member to move said second abutment member upwardly toward said first abutment member during the locking of said window assembly and to move said second abutment member downwardly away from said first abutment member during the unlocking of said window assembly, a lifting block mounted to said sash and disposed across the path of motion of said second abutment member, said lifting block being disposed against said second abutment member when said window assembly is in said locked position to minimize sag, and vertical adjusting structure for adjusting the vertical positioning of said lifting block.

2. The system of claim 1 wherein said second abutment member is a keeper having a vertical guide surface disposed in the path of movement of said second abutment member, and said lifting block being disposed at an upper portion of said vertical guide surface.

3. The system of claim 1 wherein said vertical adjusting structure comprises slots and fasteners.

4. The system of claim 2 wherein said keeper is a lower keeper and said second abutment member is a lower second abutment member, an upper keeper mounted to said sash in vertical alignment with said lower keeper, and an upper second abutment member mounted to said tie bar in vertical alignment with said lower second abutment member.

5. The system of claim 4 wherein each of said upper keeper and said lower keeper includes an inclined cam surface which merges with said vertical guide surface, said upper second abutment member being spaced from said upper keeper, and said lower second abutment member being spaced from said lower keeper by distances wherein said lower second abutment member contacts said cam edge of said lower keeper during the upward movement of said tie bar and then said lower second abutment member reaches the junction of said cam surface with said guide surface of said lower keeper when said upper second abutment member begins to contact said cam surface of said upper keeper, and then upon continued movement of said second abutment members said lower second abutment member rides against said guide surface of said lower keeper while said upper second abutment member rides against said cam surface of said upper keeper, and said movement of said tie bar continues until said lower second abutment member is located at said guide surface of said respective lower keeper and said upper second abutment member is located at said guide surface of said upper keeper.

6. The system of claim 5 wherein a lifting block is provided for each of said keepers.

7. The system of claim 5 wherein said lifting block is provided for said lower keeper, and said upper keeper has no lifting block.

8. The system of claim 2 wherein said lifting block is integral with said keeper.

9. The system of claim 2 wherein said lifting block is a member separate and distinct from said keeper.

10. The system of claim 1 including vertical adjusting structure for adjusting the vertical positioning of said lifting block.

11. The system of claim 1 wherein said second abutment member is a frusto conically shaped roller.

12. The system of claim 3 wherein said lifting block is separate and distinct from said keeper, and said lifting block having vertical adjusting structure.

13. The system of claim 2 wherein said handle is connected to said tie bar by a link mounted to a pin on said tie bar.

14. The system of claim 2 wherein said second abutment member is a cylindrically shaped roller.

15. The system of claim 14 wherein said roller includes a shoulder extending outwardly from an end of said roller for contacting a flange on said keeper.

16. A system for minimizing sag in a window assembly comprising a sash hinged to a frame for selectively being moved to a locked position and an unlocked position, said system including a first abutment member on said sash, a tie bar on said frame, a second abutment member on said tie bar, a handle connected to said tie bar for moving said tie bar and said second abutment member to move said second abutment member upwardly toward said first abutment member during the locking of said window assembly and to move said second abutment member downwardly away from said first abutment member during the unlocking of said window assembly, a lifting block mounted to said sash and disposed across the path of motion of said second abutment member, said lifting block being disposed against said second abutment member when said window assembly is in said locked position to minimize sag, said first abutment member being a keeper having a vertical guide surface disposed in the path of movement of said second abutment member, said lifting block being disposed at an upper portion of said vertical guide surface, said handle being connected to said tie bar by a link mounted to a pin on said tie bar, and said link terminating in a fork end having a pair of fork arms straddling said pin.

17. The system of claim 16 including cam structure connected to said pin for adjusting the position of said tie bar and said second abutment member.

18. A system for minimizing sag in a window assembly comprising a sash hinged to a frame for selectively being moved to a locked position and an unlocked position, said system including a first abutment member on said sash, a tie bar on said frame, a second abutment member on said tie bar, a handle connected to said tie bar for moving said tie bar and said second abutment member to move said second abutment member upwardly toward said first abutment member during the locking of said window assembly and to move said second abutment member downwardly away from said first abutment member during the unlocking of said window assembly, a lifting block mounted to said sash and disposed across the path of motion of said second abutment member, said lifting block being disposed against said second abutment member when said window assembly is in said locked position to minimize sag, said first abutment member being a keeper having a vertical guide surface disposed in the path of movement of said second abutment member, said lifting block being disposed at an upper portion of said vertical guide surface, said second abutment member being a cylindrically shaped roller, and said lifting block having an arcuate contact surface completely across the path of motion of said roller.

19. In a method for minimizing sag in a window assembly wherein a sash is hinged to a frame for selectively moving the sash to a locked position and an unlocked position; forming the frame by welding frame members together to form a completed frame; forming the sash by securing sash members together to form a completed sash; mounting a first abutment member on the sash; mounting a tie bar on the frame; mounting a second abutment member on the tie bar; connecting a handle to the tie bar for moving the tie bar and the second abutment member selectively upwardly toward the first abutment member during the locking of the window assembly and selectively moving the second abutment member downwardly away from the first abutment member during the unlocking of the window assembly; the improvement being in mounting a lifting block to the sash at a location where the lifting block extends across the path of motion of the second abutment member; moving the tie bar and second abutment member upwardly until the second abutment member contacts the lifting block to prevent further upward movement of the second abutment member relative to the lifting block, and mounting the lifting block to the sash after the completed frame and the completed sash have been formed so as to accurately locate the lifting block in its proper position with respect to the tie bar and second abutment member.

20. The method of claim 19 including positioning the lifting block on the sash through the use of a gauge.

21. The method of claim 20 wherein the gauge comprises a pair of longitudinal slide members in sliding contact with each other, including the steps of connecting the slide members to adjust the overall combined length of the slide members, one of the slide members being an upper member terminating in an outward extension, the other of the slide members being a lower member terminating in an outward extension extending parallel to the outward extension of the upper member, the outward extension of the upper member having a horizontal lower surface which would correspond to a point of contact by the second abutment member, the outward extension of the lower member having an upper horizontal surface set in a bottom sash arm mounting surface, the outward extension of the lower member having an outer horizontal surface placed on the bottom hinge track of the frame, the upper member having a notched shoulder opposite the outward extension of the upper member and the notched shoulder and the lower horizontal surface of the outward extension of the upper member are selectively used for determining the contact surface of the lifting block.

22. The method of claim 21 including using a cutout on the gauge as weld flash accommodating structure at the location where the outward extension of the lower member forms a corner with the remainder of the lower member.

* * * * *